US005758780A

United States Patent [19]

Baumgarten

[11] Patent Number: 5,758,780

[45] Date of Patent: Jun. 2, 1998

[54] SUSPENDABLE BRACKET FOR BOOKS, MAGAZINES AND THE LIKE

[76] Inventor: David Baumgarten, 3740 25th St., #102, San Francisco, Calif. 94110

[21] Appl. No.: 586,456

[22] Filed: Jan. 16, 1996

[51] Int. Cl.[6] ..... A47F 7/00

[52] U.S. Cl. ..... 211/46; 211/42; 312/184

[58] Field of Search ..... 211/46, 47, 189, 211/42; 312/184, 233; 248/306; 402/4, 36, 38, 80 R

[56] References Cited

U.S. PATENT DOCUMENTS

| | | | |
|---|---|---|---|
| 1,112,775 | 10/1914 | Crutcher . | |
| 1,257,611 | 2/1918 | Kelly . | |
| 1,404,240 | 1/1922 | Shupe . | |
| 2,732,841 | 1/1956 | Schade | 281/4 |
| 2,736,318 | 2/1956 | Shannon | 211/46 |
| 2,947,421 | 8/1960 | Schaefer . | |
| 2,967,623 | 1/1961 | Schaefer . | |
| 3,174,626 | 3/1965 | West | 211/42 |
| 3,572,867 | 3/1971 | Cooper | 312/184 |
| 3,664,051 | 5/1972 | Benichou | 40/359 |
| 3,801,175 | 4/1974 | Giulie | 312/184 |
| 3,885,726 | 5/1975 | Fridlund et al. | 312/184 X |
| 4,031,646 | 6/1977 | de Nouël | 40/359 |
| 4,053,057 | 10/1977 | Snowden | 211/126 |
| 4,079,533 | 3/1978 | Rohner | 40/359 |
| 4,294,028 | 10/1981 | Remond | 40/359 |
| 4,395,058 | 7/1983 | Terrell | 312/184 X |
| 4,474,316 | 10/1984 | Philibert | 223/88 |
| 4,530,176 | 7/1985 | Rejwan | 312/184 X |
| 4,540,094 | 9/1985 | Norrie et al. | 312/184 X |
| 4,666,047 | 5/1987 | Fletcher | 312/184 X |
| 4,674,637 | 6/1987 | Lovelock et al. | 312/184 X |
| 4,681,232 | 7/1987 | Du Corday | 211/46 |
| 4,722,626 | 2/1988 | Abildgaard | 312/184 X |
| 4,842,435 | 6/1989 | Thomas et al. | 312/184 X |
| 4,882,864 | 11/1989 | Selwyn-Smith | 40/359 |
| 4,893,745 | 1/1990 | Weber et al. | 229/1.5 R |
| 5,066,045 | 11/1991 | Hawes, Jr. et al. | 281/45 |
| 5,160,296 | 11/1992 | Katz | 462/6 |
| 5,179,765 | 1/1993 | Sungberg | 24/67.9 |
| 5,187,888 | 2/1993 | O'Brien et al. | 40/359 |
| 5,213,370 | 5/1993 | Hood | 281/36 |
| 5,226,734 | 7/1993 | Scott et al. | 312/184 X |
| 5,338,126 | 8/1994 | Mullin et al. | 402/64 |
| 5,380,111 | 1/1995 | Westrom | 402/74 |
| 5,405,209 | 4/1995 | Johns et al. | 402/28 |
| 5,417,508 | 5/1995 | Friedman | 402/19 |
| 5,425,592 | 6/1995 | Mullin et al. | 402/64 |

*Primary Examiner*—Robert W. Gibson, Jr.
*Attorney, Agent, or Firm*—Philip H. Albert; Townsend and Townsend and Crew

[57] ABSTRACT

A suspension bracket (10) holds a bound article (12, 86) in a suspension rail frame (14, 82). The suspension bracket has a structural arm (32) with an ear (24) on each end, adapted to hang from rails of the suspension rail frame, and a support arm (34), adapted to fit between pages of the bound article. The support arm and structural arm are attached at one end by a hinge (20) and at the other end by a latch (22) which removably attaches the support arm to the structural arm, to holds magazines, books and the like in the suspension rail frame.

10 Claims, 6 Drawing Sheets

SUSPENDABLE BRACKET FOR BOOKS, MAGAZINES AND THE LIKE

TECHNICAL FIELD OF THE INVENTION

The invention relates to an suspendable bracket for books, magazines and the like, such as might be used in a filing cabinet adapted for holding suspended files.

BACKGROUND OF THE INVENTION

As is well known in the art, a filing cabinet can be adapted with suspension rails for holding hanging folders. For example, U.S. Pat. No. 5,066,045 shows a hanging folder which has two sides, each of which has two ears (notches 22), the ears being complementary to a suspension rail frame typically found in a filing cabinet drawer. The hanging folder is suitable for filing papers, but has limited usefulness for books or magazines, as books tend to be too large to fit into a hanging folder and magazines cannot generally support their own weight standing vertically as individual papers can.

One proposed solution is shown in U.S. Pat. No. 5,358,125. Therein, a system for hanging binders is disclosed. In that system, two support devices (110) are attached to a binder to allow the binder to be hung in a suspension rail frame. This approach to the problem, however, requires knowing the binder thickness in advance and requires a sturdy binder. Binders come in standard thicknesses, such as ½", 1", 2", etc., so only a small number of different support devices need to be kept on hand. Unfortunately, those devices are not practical for books because books vary in thicknesses. Additionally, since those support devices rely on ends of the binder to carry the weight of the binder, they cannot be used on heavy books, as the devices would tear the binding. The support devices also cannot be used for magazines, since the typical magazine is not thick enough and cannot support its weight on the ends of its spine.

Thus, what is needed is an system for suspending books and magazines in a suspension rail frame which accommodates variable sizes of books and magazines.

SUMMARY OF THE INVENTION

The present invention provides an improved suspension bracket. In its preferred form, the suspension bracket has a partially detachable support arm flexibly attached to a main body of the suspension bracket, the main body having ears at each end complementing suspension rails, a writing surface thereon for use in identifying the article held, a reinforcement bar running at least partially along the length of the main body, a hinge and a latch. In specific embodiments, the suspension bracket also includes a retainer ridge for holding snap-on labels and the upper edge of the support arm is rounded to provide low friction for inserting the article to be suspended and to prevent damage to the article. The writing surface can be a rewritable surface.

In an alternate embodiment, for use in horizontal filing systems, an attachment is provided for displaying a label on a side edge of the suspended article. The attachment is attached over one end of the suspension bracket (preferably the end which is most visible to a user of the horizontal filing system) and includes a vertical label slat.

Further understanding of the nature and advantages of the present invention may be realized by reference to the remaining portions of the specification and the attached drawings.

DESCRIPTION OF THE PREFERRED EMBODIMENT

Figure 1:
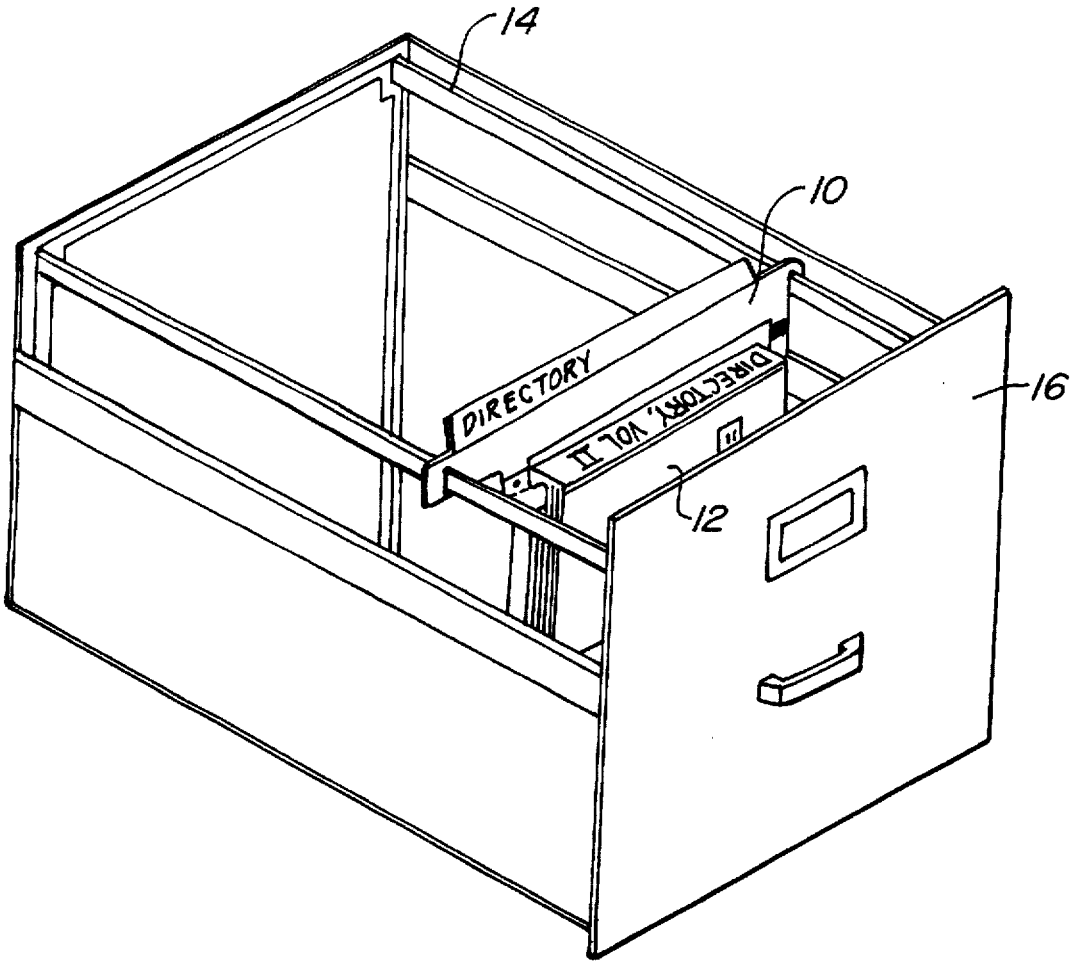
FIG. 1 is perspective view of a filing cabinet drawer and a suspension rail frame in which a suspension bracket according to the present invention is hung.

FIG. 1 illustrates a use of a suspension bracket 10 according to the present invention to suspend a book 12 or other bound article from a suspension rail frame 14 installed in a file cabinet drawer 16. Although not shown, file cabinet drawer 16 might also contain other bound articles suspended with additional suspension brackets 10 as well as conventional hanging files with papers filed therein. In a preferred embodiment, suspension bracket is made from molded plastic.

Figure 2:
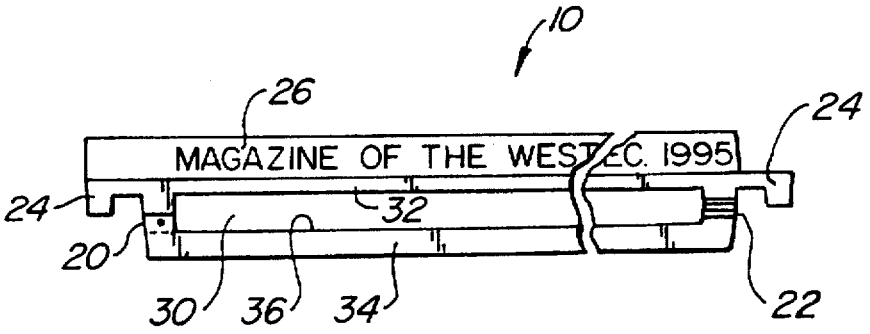
FIGS. 2 and 2A are front and side views of the suspension bracket shown in FIG. 1.
Figure 2A:
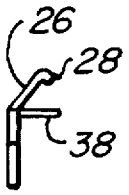

FIGS. 2 and 2A are front and side views of suspension bracket 10. Suspension bracket 10 is formed of a structural arm 32, which has two ears 24, one on each end, the ears 24 adapted to support suspension bracket 10 between the rails of a suspension rail frame such as suspension rail frame 14 shown in FIG. 1. A support arm 34, flexibly attached at one end to structural arm 32 by a hinge 22 and releasably attached at the other end with a latch 20, is provided to suspend the bound article. Support arm 34 has a rounded upper edge 36 to prevent damage to the bound article and for ease of insertion of the bound article. Latch 20, hinge 22, structural arm 32 and support arm 34 together form an aperture 30 into which the bound article is placed. While that which is suspended is referred to herein as a bound article, it should be apparent that an unbound item can also be hung from suspension bracket 10, so long as the item can be folded over support arm 34.

A writable surface 26 with a retainer ridge 28 is provided on a top portion of suspension bracket 10 for easy labelling of the bound article. A reinforcement bar 38 (see FIG. 2A) is provided for cross support of heavy articles. Some embodiments of suspension brackets according to the present invention for use with lighter articles do not require reinforcement bar 38.

Figure 3:
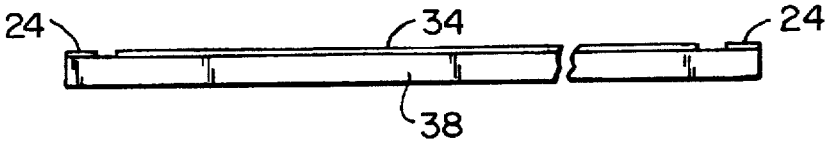
FIG. 3 is a bottom view of the suspension bracket shown in FIG. 2.

FIG. 3 is a bottom view of suspension bracket 10, more clearly showing reinforcement bar 38.

To hang a bound article, latch 20 is released to free one end of support arm 34 from structural arm 32. When latch 20 is released, hinge 22 allows support arm 34 to swing freely, or as freely as is needed, to allow support arm 34 to be inserted between pages of the bound article. Depending on the nature of hinge 22, support arm 34 could be free to move up and down or side to side, although moving in one direction is all that is typically needed to mount a bound article on suspension bracket 10. The hinge shown in FIG. 2 is an accordion hinge, but other hinges can be substituted therefor, such as a swivel hinge.

Once support arm 34 is inserted through the bound article, support arm 34 is again latched to structural arm 32 using latch 20. Latch 20 might be a snap latch or the like. The bound article can now be hung in a suspension rail frame such as suspension rail frame 14 shown in FIG. 1. A title or other identification of the hung article can be written on surface 26, or clip tabs (not shown) can be attached over surface 26 and held in place by retainer ridge 28.

Figure 4:
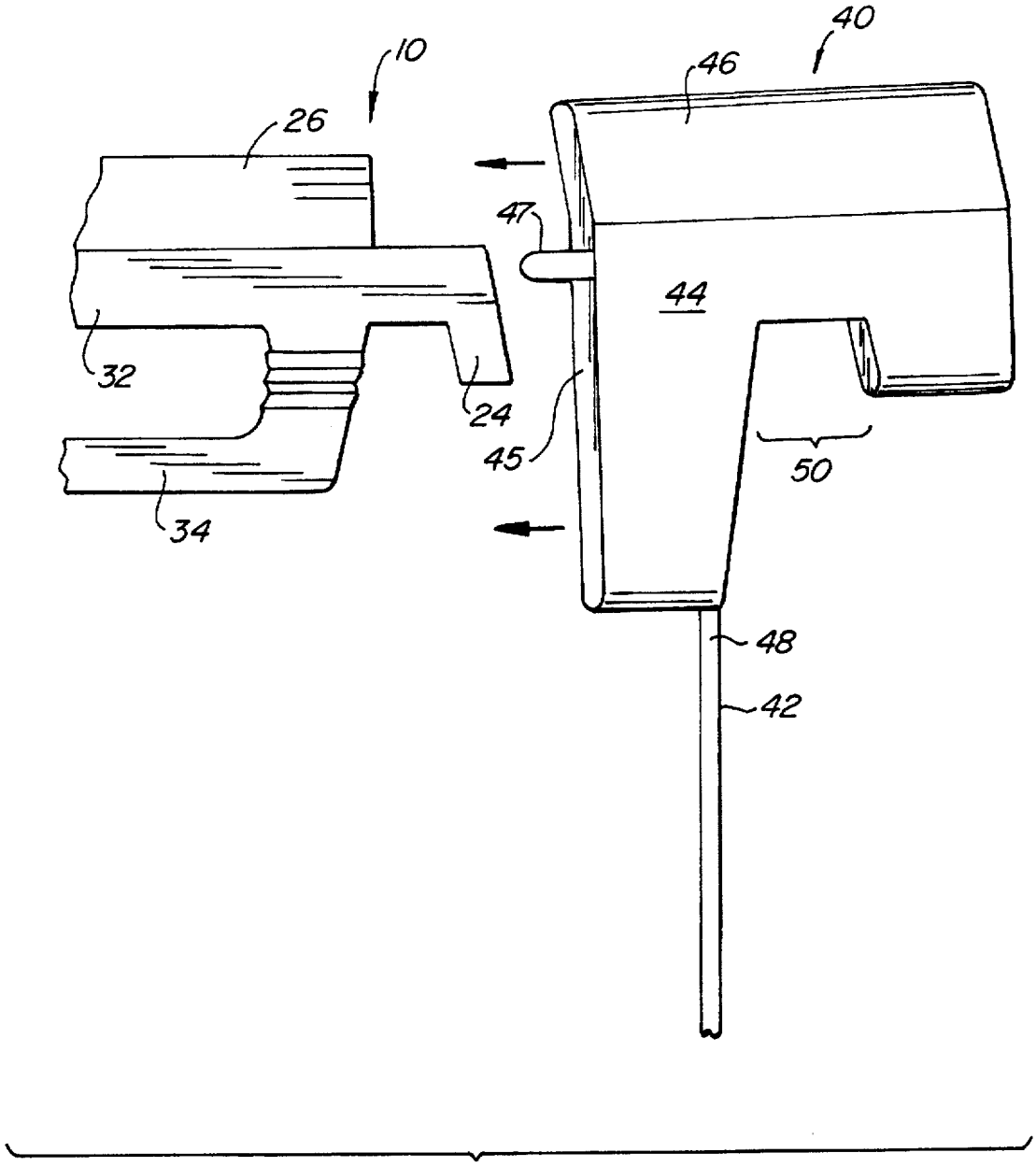
FIG. 4 is a front view of a portion of a side label attachment according to the present invention being mounted over the hinged end of the suspension bracket shown in FIG. 2.

FIG. 4 is a front view of a side label attachment 40 for attachment to a suspension bracket. With a side label attachment, a hanging file can be identified with a label visible from the side of the hanging file. As should be apparent, side label attachment 40 can be attached to a conventional hanging file folder as well as suspension bracket 10. Side label attachment 40 is shown in FIG. 4 with a side label surface 42 on a side label slat 48 supported on a conforming body 44. An additional writing surface is provided by a front label surface 46 which is the portion of side label attachment 40 which slips over writing surface 26 on suspension bracket 20. Optionally, side label slat 48 includes an attached label cover (not shown) which is clear acrylic and has magnifying properties.

Side label surface 42 can be a rewritable surface and can be adapted to accept snap-on labels. Snap-on labels are preferred over fixed writable surfaces where it is desired to have printed labels, as the snap-on labels can include paper labels which fit easily into a typewriter or printer.

To install side label attachment 40 to suspension bracket 10, suspension bracket 10 is inserted, ear 24 first, into opening 45 of side label attachment 40, working ear 24 over a notch 50 and reinforcement bar 38 into a corresponding slot 47. Notch 50 complements a rail of the suspension rail frame in which suspension bracket 10 is held. If either writing surface 26 or reinforcement bar 38 do not extend to the end of suspension bracket 10, front label surface 46 and slot 47 can be modified accordingly or eliminated altogether.

Figure 5:
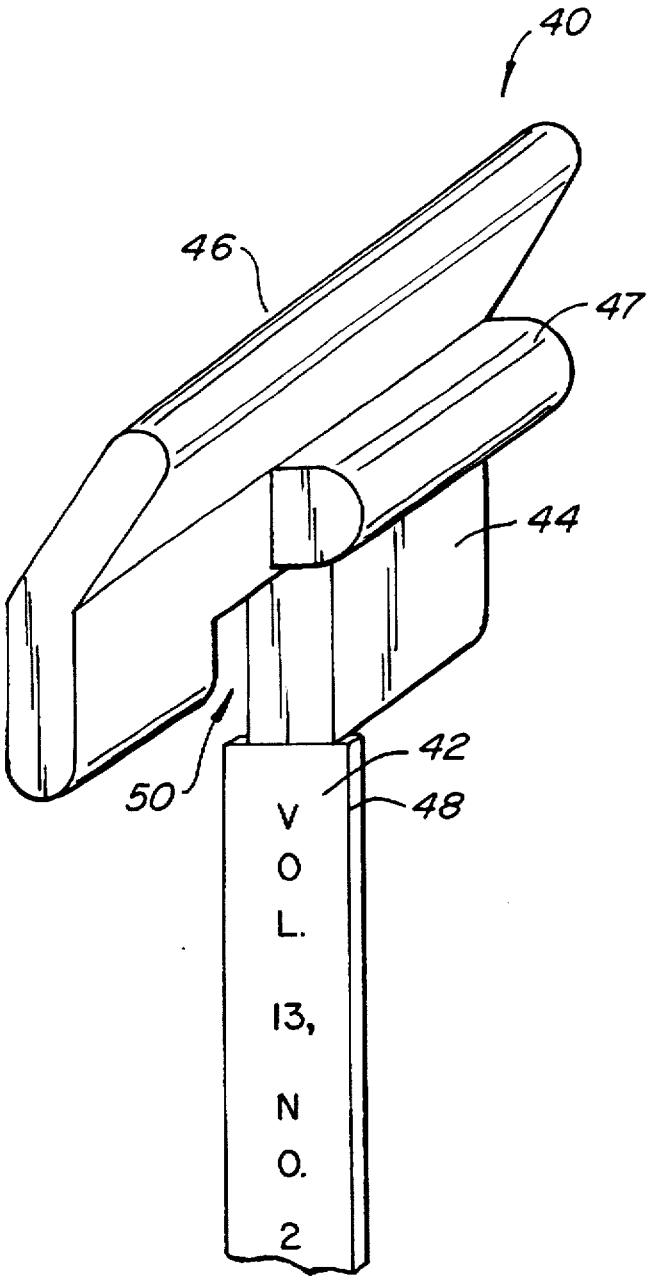
FIG. 5 is a side view of the upper portion of the side label attachment shown in FIG. 4, taken from the left and behind the side label attachment view of FIG. 4.

FIG. 5 is a side view of side label attachment 40 shown in FIG. 4, the side view more clearly illustrating how the side label appears. Although not shown, label slat 48 can run the depth of a suspension rail frame or can run just enough to fit a small label. Label information could be added either before or after the side label attachment is attached to suspension bracket 10.

Side label attachment 40 is designed to fit on a specific end of suspension bracket 10, however this is typically not a problem, since a office is likely to have a convention of all the files in a horizontal filing system running the same direction, thus a given office would only need one type of side label attachment. Of course, if suspension bracket 10 were modified to have a vertical writing surface 26 (which in most instances is not preferred) and either a partial reinforcement bar or a symmetrical reinforcement bar, side label attachment 40 could fit on either side of suspension bracket 10. If side label attachments are needed which can fit either side of a nonsymmetrical suspension bracket in a horizontal filing system, a side label attachment 60 as shown in FIG. 6 could be used.

Figure 6:
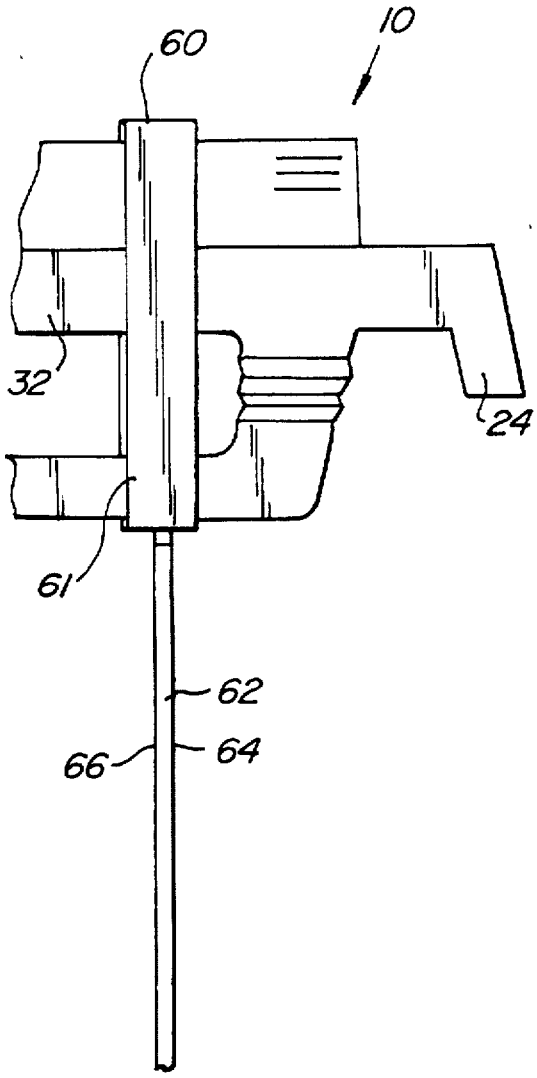
FIG. 6 is a front view of an alternate embodiment of a side label attachment attached to the suspension bracket shown in FIG. 2.
Figure 7:
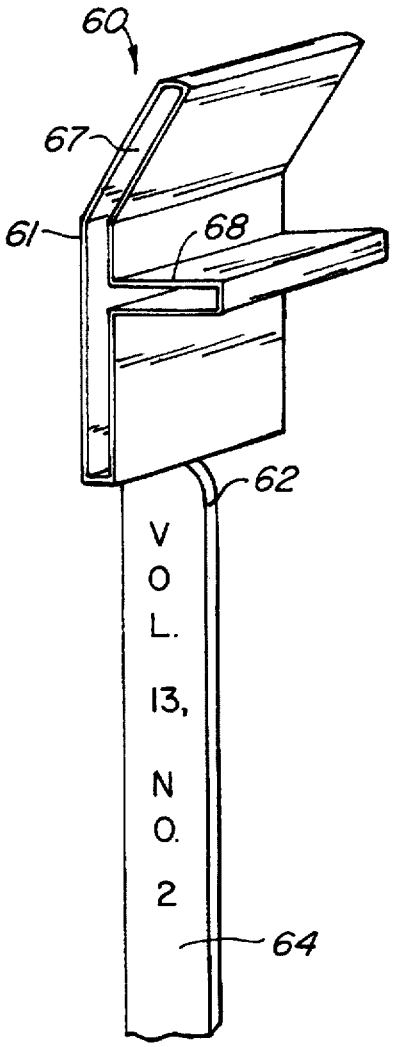
FIG. 7 is a side view of the side label attachment shown in FIG. 6.

FIGS. 6 and 7 are front and side views of an alternate embodiment of the side label attachment 40 shown in FIGS. 4–5. Side label attachment 60 shown attached to suspension bracket 10 and is formed of a looping clip 61 attached to a label slat 62. Looping clip 61 is a hollow ring which matches the contour of suspension bracket 10. Label slat 62 has two label surfaces 64, 66 so that a label surface is visible regardless which side of suspension bracket 10 side label attachment 60 is placed upon.

FIG. 7 is a side view of side label attachment 60 (FIG. 6 is the corresponding front view). As can be seen from the figure, looping clip 61 follows the contour of suspension bracket 10 and thus, if reinforcement bar 38 (see FIGS. 2–3) does not run the entire length of structural arm 32 or the slant of writing surface 26 is changed, then portions 67 and 68 should be modified accordingly. In use, the visible surface of surface 64 or 66 is labelled.

Figure 8:
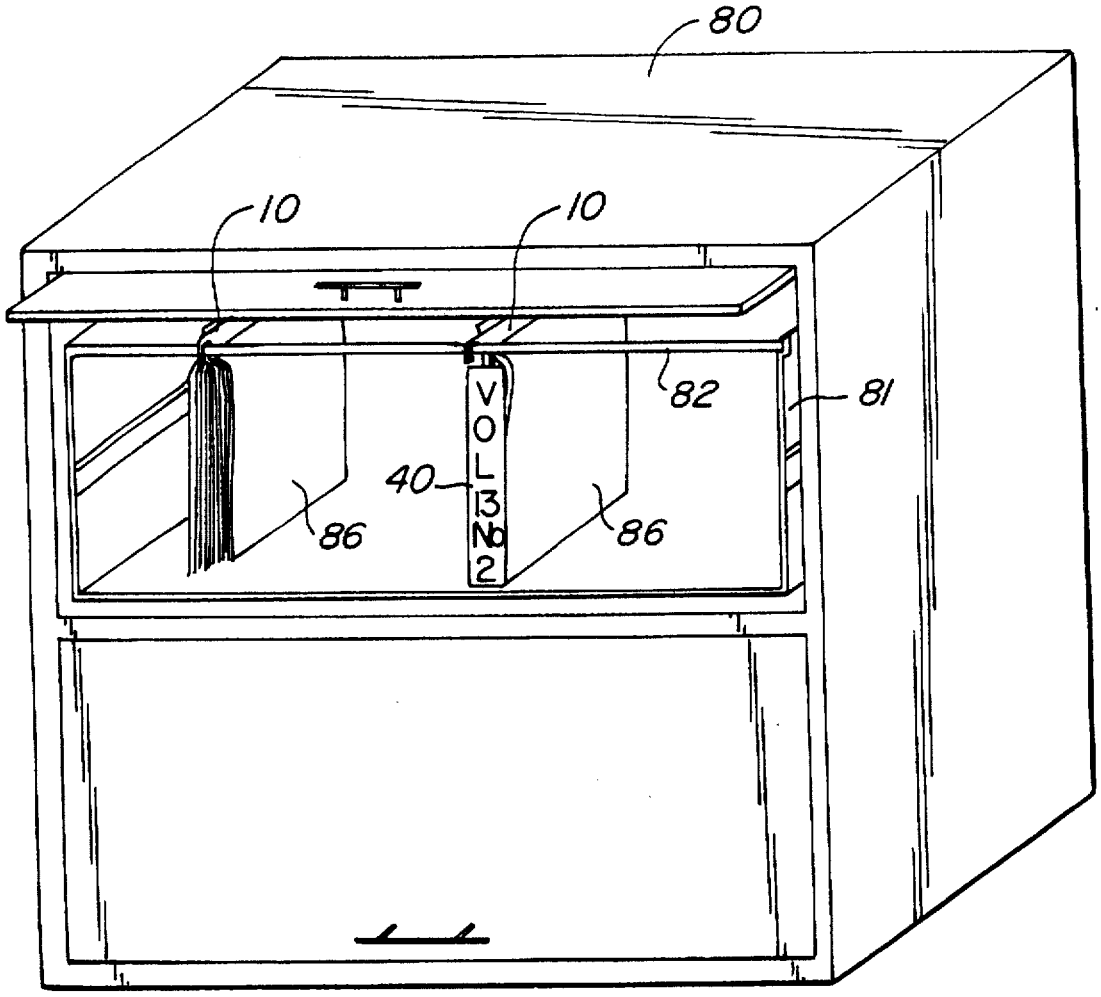
FIG. 8 is an illustration of a usage of a side label attachment such as the side label attachments shown in FIGS. 6–7.

FIG. 8 is an illustration of a usage of a side label attachment such as the side label attachments shown in FIGS. 6–7. FIG. 8 shows a horizontal filing cabinet 80 with a drawer 81 supporting a suspension rail frame 82, such as might be used in a medical office. Drawer 81 slides in and out of horizontal filing cabinet 80 to allow for insertion and removal of files. Two bound articles 86 are shown hanging from suspension brackets 10, with the suspension bracket 84 on the left having side label attachment 40 attached thereto. As should be apparent, the use of side label attachment 40 allows for the identification of the article on the left without having to open drawer 81.

In the foregoing specification, the invention has been described with reference to specific preferred embodiments and methods. It will, however, be evident to those of skill in the art that various modifications and changes may be made without departing from the broader spirit and scope of the invention as set forth in the attendant claims. The specification and drawings are, accordingly, to be regarded in an illustrative, rather than restrictive, sense; the invention being limited only by the appended claims.

What is claimed is:

1. A suspension bracket, adapted to suspend a bound article in a suspension rail frame, comprising:

a structural arm having first and second ends;

a writable surface attached to the structural arm, wherein the writable surface is a surface which is visible when the bound article is hung on the support arm and accepts writing thereon;

two suspension rail frame engagement elements at the first and second ends of the structural arm;

a support arm, adapted to fit between pages of the bound article, the support arm having first and second ends;

a hinge which flexibly attaches the first end of the support arm to the first end of the structural arm; and a latch which removably attaches the second end of the support arm to the second end of the structural arm.

2. The suspension bracket of claim 1, wherein the writable surface further comprises a retainer ridge.

3. The suspension bracket of claim 1, wherein the writable surface further comprises a means for retaining an attachable label.

4. The suspension bracket of claim 1, wherein the writable surface is a surface which accepts writing and is an erasable surface.

5. A suspension bracket, adapted to suspend a bound article in a suspension rail frame, comprising:

a structural arm having first and second ends;

two suspension rail frame engagement elements at the first and second ends of the structural arm;

a support arm, adapted to fit between pages of the bound article, the support arm having first and second ends;

a hinge which flexibly attaches the first end of the support arm to the first end of the structural arm, wherein the hinge is a swivel hinge, thereby allowing for movement of the second end of the support arm in several directions when the second end of the support arm is detached from the second end of the structural arm; and a latch which removably attaches the second end of the support arm to the second end of the structural arm.

6. The suspension bracket of claim 1, further comprising a reinforcement bar attached perpendicularly to the structural arm.

7. A suspension bracket, adapted to suspend a bound article in a suspension rail frame, comprising:

a structural arm having first and second ends;

a writable surface attached to the structural arm and angled out of a plane defined by the structural arm, to provide for easy viewing, the writable surface including a retainer ridge;

a reinforcement bar attached perpendicularly to the structural arm;

two suspension rail frame engagement elements at the first and second ends of the structural arm;

a support arm, adapted to fit between pages of the bound article, the support arm having first and second ends;

a hinge which flexibly attaches the first end of the support arm to the first end of the structural arm; and a latch which removably attaches the second end of the support arm to the second end of the structural arm.

8. The suspension bracket of claim 5, further comprising a reinforcement bar attached perpendicularly to the structural arm.

9. The suspension bracket of claim 1, wherein an upper edge of the support arm is a rounded edge.

10. The suspension bracket of claim 5, wherein an upper edge of the support arm is a rounded edge.

* * * * *